US009354569B2

(12) United States Patent
Bayerle et al.

(10) Patent No.: US 9,354,569 B2
(45) **Date of Patent: *May 31, 2016**

(54) HEAT TRANSFER SYSTEM FOR A FUSER ASSEMBLY

(71) Applicant: Lexmark International, Inc., Lexington, KY (US)

(72) Inventors: Peter Alden Bayerle, Lexington, KY (US); Jeffery James Buchanan, Lexington, KY (US); Michael Clark Campbell, Lexington, KY (US); Benjamin Karnik Johnson, Lexington, KY (US); Charles Scott McDavid, Frankfort, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/137,407

(22) Filed: Dec. 20, 2013

(65) Prior Publication Data

US 2014/0369730 A1 Dec. 18, 2014

Related U.S. Application Data

(60) Provisional application No. 61/834,869, filed on Jun. 13, 2013.

(51) Int. Cl.
*G03G 15/20* (2006.01)

(52) U.S. Cl.
CPC ..... *G03G 15/2053* (2013.01); *G03G 15/2064* (2013.01); *G03G 15/2082* (2013.01); *G03G 15/2032* (2013.01); *G03G 15/2042* (2013.01); *G03G 2215/2035* (2013.01)

(58) Field of Classification Search
CPC ..... G03G 15/2042; G03G 15/2082
USPC ..... 399/334
See application file for complete search history.

(56) References Cited

U.S. PATENT DOCUMENTS 4,050,803 A 9/1977 Mccarroll
4,145,181 A 3/1979 Edwards et al.

(Continued)

FOREIGN PATENT DOCUMENTS

JP 01121883 A 5/1989
JP 01266557 A 10/1989
JP 06317994 A * 11/1994

OTHER PUBLICATIONS

Federal Plain Language Guidelines.*

(Continued)

*Primary Examiner* — Walter L Lindsay, Jr.
*Assistant Examiner* — Milton Gonzalez

(57) ABSTRACT

A fuser assembly for an imaging device which transfers heat from overheated portions of the fuser assembly to portions having lesser temperatures. The fuser assembly includes a heating member; a backup roll disposed proximate to the heating member for forming a fuser nip; a heat transfer device in contact with the backup roll such that rotation of the backup roll rotates the heat transfer device for transferring heat from one location to another location on the backup roll; and a positioning mechanism for moving the heat transfer device between a first position in which the heat transfer device is engaged with and contacts the backup roll, and a second position in which the heat transfer device is disengaged and spaced apart from the backup roll, the positioning mechanism pivots the heat transfer device about a pivot axis when moving between the first and second positions.

13 Claims, 11 Drawing Sheets

(56) References Cited

U.S. PATENT DOCUMENTS

| | | | | |
|---|---|---|---|---|
| 4,392,739 | A | | 7/1983 | Brown et al. |
| 4,869,707 | A | * | 9/1989 | in 't Zandt et al. |
| 5,212,528 | A | | 5/1993 | Matsuda |
| 5,384,630 | A | * | 1/1995 | Nakamura et al. |
| 5,534,984 | A | * | 7/1996 | Inoue |
| 5,629,755 | A | * | 5/1997 | Ohtsuka |
| 5,638,158 | A | * | 6/1997 | Sanpe et al. |
| 6,157,806 | A | | 12/2000 | Elbert et al. |
| 6,253,046 | B1 | | 6/2001 | Horrall et al. |
| 6,345,169 | B1 | * | 2/2002 | Haneda et al. |
| 7,349,660 | B2 | | 3/2008 | Domoto et al. |
| 7,398,028 | B2 | | 7/2008 | Nakagaki |
| 7,925,198 | B2 | | 4/2011 | Urano |
| 7,995,957 | B2 | | 8/2011 | Sone et al. |
| 8,180,269 | B2 | | 5/2012 | Beach et al. |
| 8,200,137 | B2 | | 6/2012 | Foster et al. |
| 8,238,770 | B2 | | 8/2012 | Shimizu |
| 2004/0120741 | A1 | | 6/2004 | Kim et al. |
| 2005/0025511 | A1 | * | 2/2005 | Watabe |
| 2005/0089343 | A1 | | 4/2005 | Mathers |
| 2006/0291919 | A1 | | 12/2006 | Domoto et al. |
| 2010/0054828 | A1 | | 3/2010 | Urano |
| 2010/0329705 | A1 | | 12/2010 | Cao et al. |
| 2011/0222933 | A1 | | 9/2011 | Maruyama et al. |
| 2013/0058673 | A1 | | 3/2013 | Kikkawa |
| 2013/0251392 | A1 | | 9/2013 | Ueda et al. |
| 2014/0369725 | A1 | | 12/2014 | Bayerle et al. |
| 2014/0369729 | A1 | | 12/2014 | Bayerle et al. |
| 2015/0063857 | A1 | | 3/2015 | Bayerle et al. |

OTHER PUBLICATIONS

File History for U.S. Appl. No. 14/024,980, including Non-final Office Action dated Mar. 3, 2015.

File History for U.S. Appl. No. 14/136,987, including Non-final Office Action dated Jan. 26, 2015.

International Search Report and Written Opinion of the International Searching Authority for PCT application PCT/US2014/042323, Oct. 31, 2014.

File History for U.S. Appl. No. 14/137,609, including Non-final Office Action dated Dec. 19, 2014.

Notice of Allowance for U.S. Appl. No. 14/136,987, dated Aug. 20, 2015.

Notice of Allowance for U.S. Appl. No. 14/024,980, dated Oct. 13, 2015.

Notice of Allowance for U.S. Appl. No. 14/137,609, dated Jun. 24, 2015.

* cited by examiner

HEAT TRANSFER SYSTEM FOR A FUSER ASSEMBLY

CROSS REFERENCES TO RELATED APPLICATIONS

The present application is related to and claims priority under 35 U.S.C. 119(e) from U.S. provisional application No. 61/834,869, filed Jun. 13, 2013, entitled, "Heat Transfer System for a Fuser Assembly," the content of which is hereby incorporated by reference herein in its entirety.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Disclosure

The present disclosure relates generally to a fuser assembly for an electrophotographic imaging device and particularly to a fuser assembly which transfers excess heat from one location to another location in the fuser assembly.

2. Description of the Related Art

In a belt fuser assembly for an electrophotographic imaging device, an endless belt surrounds a ceramic heating element. The belt is pushed against the heating element by a pressure roller to create the fusing nip. The heating element, typically a thick-film resistor on a ceramic slab, extends the full width of the printing process in order to suitably heat and fuse toner to the widest media sheets used with the imaging device. The fusing heat is controlled by measuring the temperature of the ceramic slab with a thermistor that is held in intimate contact with the ceramic and feeding the temperature information to a microprocessor-controlled power supply in the imaging device. In addition, the temperature of the belt is measured by a non-contact thermistor which is used to control belt temperature. The power supply applies power to the thick-film resistor when the temperature sensed by the thermistor drops below a first predetermined level, and interrupts power when the temperature exceeds a second predetermined level. In this way, the fuser assembly is maintained at temperature levels suitable for fusing toner to media sheets without overheating.

When printing, the media sheet removes heat from the fuser assembly in the portion of the fuser that contacts the media. When printing on media sheets having widths that are less than the widest media width on which the image device is capable of printing, the portion of the fuser assembly beyond the width of the media sheet does not lose any heat through the sheet and becomes hotter than the portion of the fuser assembly which contacts the media sheet. In order to prevent thermal damage to components of the fuser assembly, steps are taken to limit the overheating of the portion of the fuser assembly which does not contact narrower media sheets. Typically, the inter-page gap between successive media sheets being printed is increased when media sheets less than the full width are used, thereby decreasing the process speed of the imaging device.

As imaging device speeds increase, the tolerable range of media width variation at full speed becomes smaller. In the case of imaging devices operating at 60 pages per minute (ppm) and above, a media width difference of 3 mm to 4 mm is seen to cause overheating in the small portion of the fuser assembly which does not contact the media sheet. For example, because letter paper and A4 paper differ in width by 6 mm, with A4 paper being narrower, an imaging device designed for printing on letter width media sheets and operating at 60 ppm or greater is seen to cause the portion of the fuser not contacting the media sheet to overheat if A4 paper is used, with the result that a letter width imaging device will necessarily slow when printing A4.

One approach to print on both letter and A4 width media at full process speeds using a letter width imaging device is to have two different fuser mechanisms—one fuser mechanism having a heater of the correct length for A4 media, and a second fuser mechanism having a heater for letter width media. However, problems occur if the fuser mechanism selected for a print job does not match the media sheet width. If the fuser mechanism associated with letter width printing is used for a print job using A4 media sheets, the fuser assembly may overheat as explained above. Conversely, if the fuser mechanism associated with A4 width printing is used for a print job using letter width media, the toner on the outermost 6 mm (for a edge referenced imaging device) of the printed area is not sufficiently fused to the letter width media sheet.

Based upon the foregoing, a need exists for an improved fuser assembly for use with printing on narrower media sheets.

SUMMARY

Example embodiments of the present disclosure overcome shortcomings in existing imaging devices and satisfy a need for a fuser assembly that transfers heat from a first portion of the fuser assembly having higher temperatures to a second portion of the fuser assembly having a lower temperature than the first portion.

According to an example embodiment, there is disclosed a fuser assembly including a heating member; a backup roll disposed proximate to the heating member so as to form a fuser nip therewith, wherein rotation of the backup roll causes the heating member to rotate; and a heat transfer device in contact with the backup roll such that rotation of the backup roll rotates the heat transfer device. The heat transfer device is used to transfer heat from a portion of the backup roll having higher temperatures, due to not contacting a narrower media sheet during a fusing operation, to a portion thereof having a lower temperature from contacting the media sheet. In this way, overheating of the backup roll and the heating member due to printing on narrower media sheets is substantially prevented. The example embodiment further includes a positioning mechanism for moving the heat transfer device between a first position in which the heat transfer device is engaged with and contacts the one of the backup roll and the heating member and a second position in which the heat transfer device is disengaged and spaced apart therefrom. The positioning mechanism may pivot the heat transfer device about a pivot axis when moving between the first and second positions.

In an example embodiment, the positioning mechanism may include a pair of bell cranks, each bell crank having a first end portion pivotably coupled to the fuser housing at a pivot point and a second end portion to which an end of the heat transfer device is coupled. The pivot points of the bell cranks define the pivot axis about which the heat transfer device pivots when moving between the first and second positions.

BRIEF DESCRIPTION OF THE DRAWINGS

The above-mentioned and other features and advantages of the disclosed example embodiments, and the manner of attaining them, will become more apparent and will be better understood by reference to the following description of the disclosed example embodiments in conjunction with the accompanying drawings, wherein.

DETAILED DESCRIPTION

Figure 1:
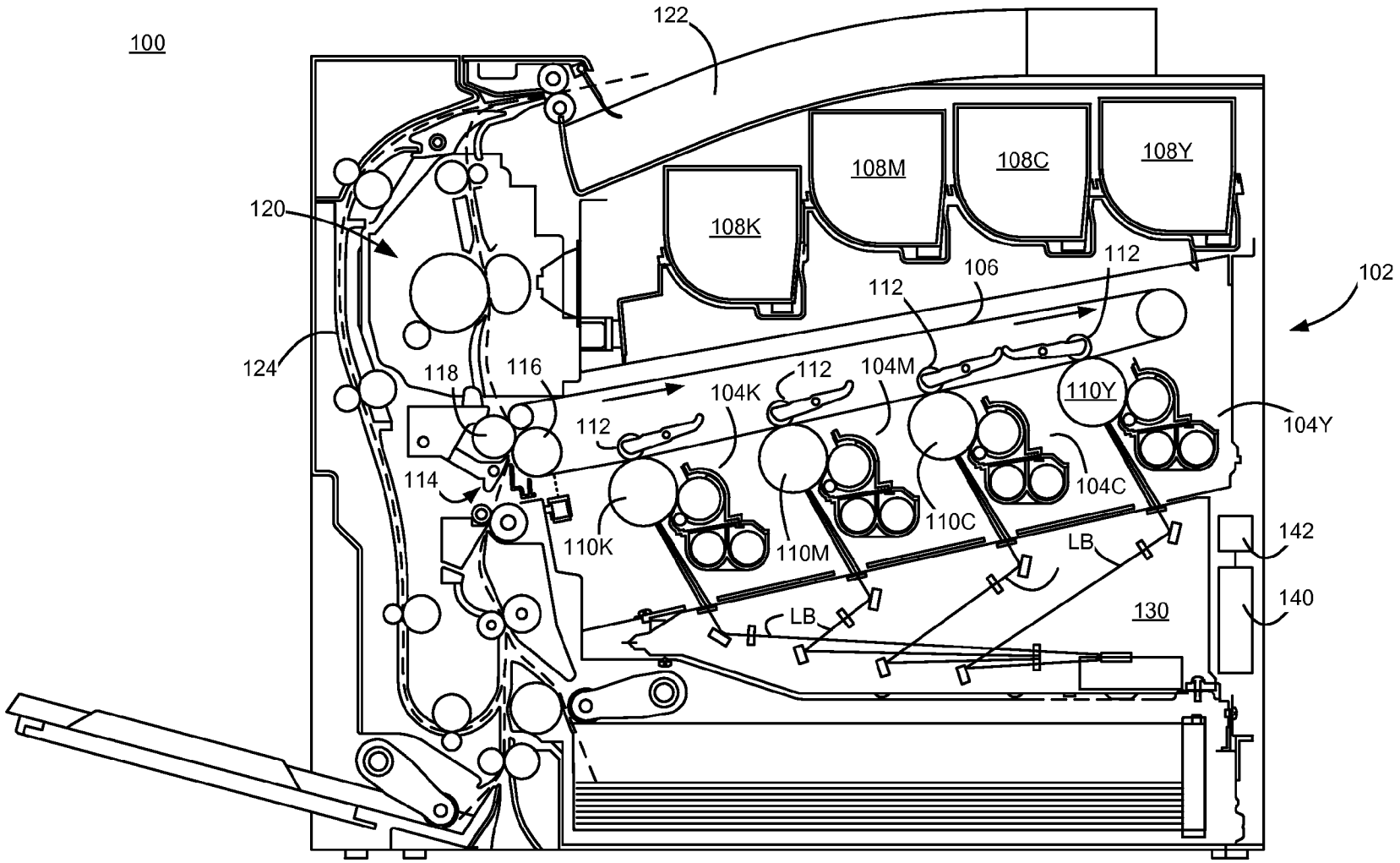
FIG. 1 is a side elevational view of an image forming apparatus according to an example embodiment.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and positionings. In addition, the terms "connected" and "coupled" and variations thereof are not restricted to physical or mechanical connections or couplings.

Spatially relative terms such as "top", "bottom", "front", "back" and "side", and the like, are used for ease of description to explain the positioning of one element relative to a second element. Terms such as "first", "second", and the like, are used to describe various elements, regions, sections, etc. and are not intended to be limiting. Further, the terms "a" and "an" herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

FIG. 1 illustrates a color image forming device 100 according to an example embodiment. Image forming device 100 includes a first toner transfer area 102 having four developer units 104 that substantially extend from one end of image forming device 100 to an opposed end thereof. Developer units 104 are disposed along an intermediate transfer member (ITM) 106. Each developer unit 104 holds a different color toner. The developer units 104 may be aligned in order relative to the direction of the ITM 106 indicated by the arrows in FIG. 1, with the yellow developer unit 104Y being the most upstream, followed by cyan developer unit 104C, magenta developer unit 104M, and black developer unit 104K being the most downstream along ITM 106.

Each developer unit 104 is operably connected to a toner reservoir 108 for receiving toner for use in a printing operation. Each toner reservoir 108 is controlled to supply toner as needed to its corresponding developer unit 104. Each developer unit 104 is associated with a photoconductive member 110 that receives toner therefrom during toner development to form a toned image thereon. Each photoconductive member 110 is paired with a transfer member 112 for use in transferring toner to ITM 106 at first transfer area 102.

During color image formation, the surface of each photoconductive member 110 is charged to a specified voltage, such as −800 volts, for example. At least one laser beam LB from a printhead or laser scanning unit (LSU) 130 is directed to the surface of each photoconductive member 110 and discharges those areas it contacts to form a latent image thereon. In one embodiment, areas on the photoconductive member 110 illuminated by the laser beam LB are discharged to approximately −100 volts. The developer unit 104 then transfers toner to photoconductive member 110 to form a toner image thereon. The toner is attracted to the areas of the surface of photoconductive member 110 that are discharged by the laser beam LB from LSU 130.

ITM 106 is disposed adjacent to each of developer unit 104. In this embodiment, ITM 106 is formed as an endless belt disposed about a drive roller and other rollers. During image forming operations, ITM 106 moves past photoconductive members 110 in a clockwise direction as viewed in FIG. 1. One or more of photoconductive members 110 applies its toner image in its respective color to ITM 106. For monocolor images, a toner image is applied from a single photoconductive member 110K. For multi-color images, toner images are applied from two or more photoconductive members 110. In one embodiment, a positive voltage field formed in part by transfer member 112 attracts the toner image from the associated photoconductive member 110 to the surface of moving ITM 106.

ITM 106 rotates and collects the one or more toner images from the one or more developer units 104 and then conveys the one or more toner images to a media sheet at a second transfer area 114. Second transfer area 114 includes a second transfer nip formed between at least one back-up roller 116 and a second transfer roller 118.

Fuser assembly 120 is disposed downstream of second transfer area 114 and receives media sheets with the unfused toner images superposed thereon. In general terms, fuser assembly 120 applies heat and pressure to the media sheets in order to fuse toner thereto. After leaving fuser assembly 120, a media sheet is either deposited into output media area 122 or enters duplex media path 124 for transport to second transfer area 114 for imaging on a second surface of the media sheet.

Image forming device 100 is depicted in FIG. 1 as a color laser printer in which toner is transferred to a media sheet in a two step operation. Alternatively, image forming device 100 may be a color laser printer in which toner is transferred to a media sheet in a single step process—from photoconductive members 110 directly to a media sheet. In another alternative embodiment, image forming device 100 may be a monochrome laser printer which utilizes only a single developer unit 104 and photoconductive member 110 for depositing black toner directly to media sheets. Further, image forming device 100 may be part of a multi-function product having, among other things, an image scanner for scanning printed sheets.

Image forming device 100 further includes a controller 140 and memory 142 communicatively coupled thereto. Though not shown in FIG. 1, controller 140 may be coupled to components and modules in image forming device 100 for controlling same. For instance, controller 140 may be coupled to toner reservoirs 108, developer units 104, photoconductive members 110, fuser assembly 120 and/or LSU 130 as well as to motors (not shown) for imparting motion thereto. It is understood that controller 140 may be implemented as any number of controllers and/or processors for suitably controlling image forming device 100 to perform, among other functions, printing operations.

Figure 2:
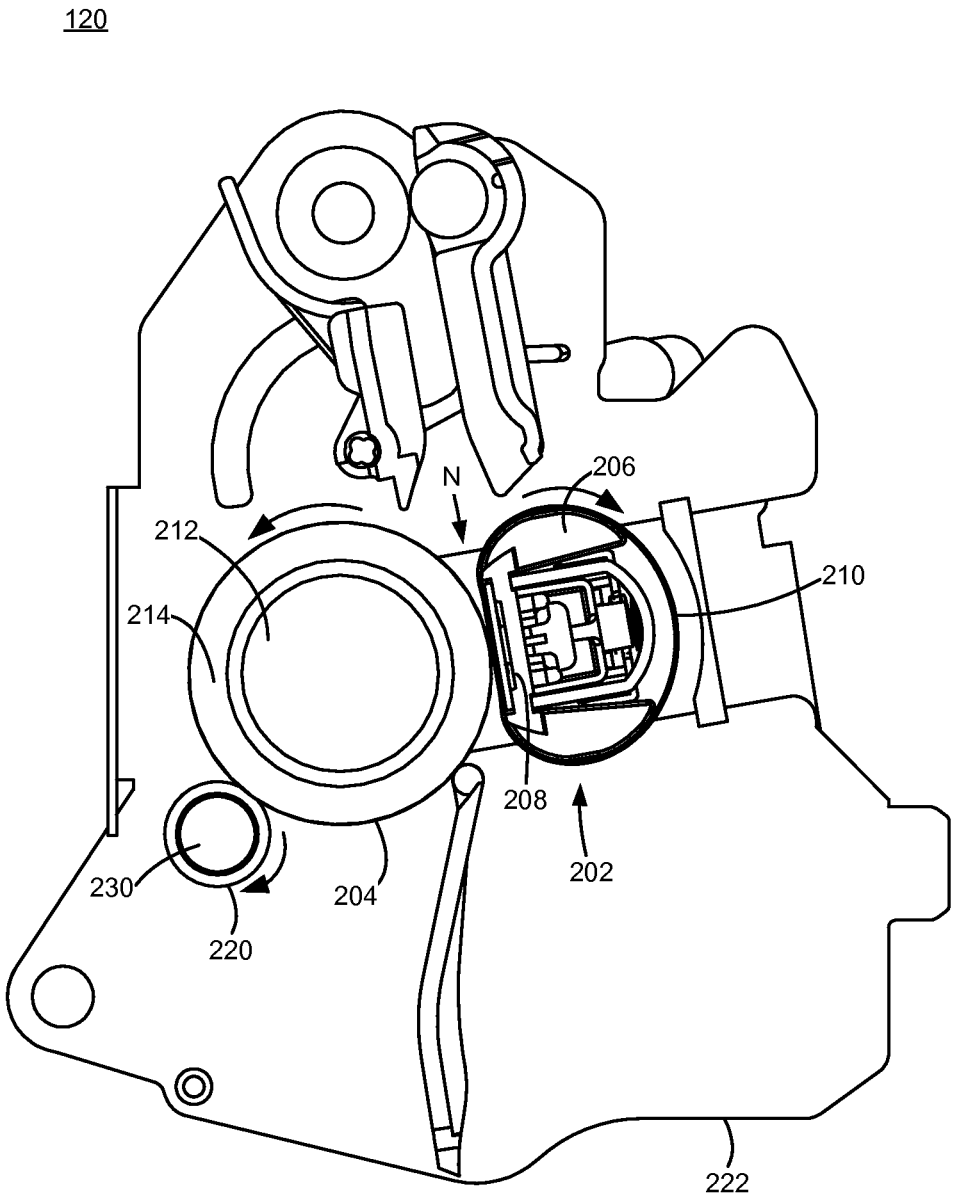
FIG. 2 is a side view of a fuser assembly of FIG. 1 according to an example embodiment.

With respect to FIG. 2, in accordance with an example embodiment, fuser assembly 120 may include a heating member 202 and a backup roll 204 cooperating with the heating member 202 to define a fuser nip N for conveying media sheets therein. The heating member 202 may include a housing 206, a heater element 208 supported on or at least partially within housing 206, and an endless flexible fuser belt 210 positioned about housing 206. Heater element 208 may be formed from a substrate of ceramic or like material to which one or more resistive traces is secured which generates heat when a current is passed through the resistive traces. Heater element 208 may further include at least one temperature sensor, such as a thermistor, coupled to the substrate for detecting a temperature of heater element 208. It is understood that heater element 208 alternatively may be implemented using other heat generating mechanisms.

Belt 210 is an endless belt that is disposed around housing 206 and heater element 208. Belt 210 may include a flexible thin film, and specifically includes a stainless steel tube; an elastomeric layer, such as a silicone rubber layer covering the stainless steel tube; and a release layer, such as a PFA (polyperfluoroalkoxy-tetrafluoroethylene) sleeve or coating covering the elastomeric layer. The release layer of belt 210 is formed on the outer surface of the elastomeric layer so as to contact media sheets passing between the heating member 202 and backup roll 204.

Backup roll 204 may include a hollow core 212 covered with an elastomeric layer 214, such as silicone rubber, and a fluororesin outer layer (not shown), may be formed, for example, by a spray coated PFA (polyperfluoroalkoxy-tetrafluoroethylene) layer, PFA-PTFE (polytetrafluoroethylene) blended layer, or a PFA sleeve. Backup roll 204 may have an outer diameter between about 30 mm and about 46 mm and may be driven by a fuser drive train (not shown) to convey media sheets through the fuser assembly 120. Belt 210 contacts backup roll 204 such that belt 210 rotates about housing 206 and heater element 208 in response to backup roll 204 rotating. With belt 210 rotating about housing 206 and heater element 208, the inner surface of belt 210 contacts heater element 208 so as to heat fuser belt 210 to a temperature sufficient to perform a fusing operation for fusing toner to sheets of media.

Heating member 202 and backup roll 204 may be constructed from the elements and in the manner as disclosed in U.S. Pat. Nos. 7,235,761 and 8,175,482 the contents of which are incorporated by reference herein in their entirety. It is understood, though, that fuser assembly 120 may have a different architecture than a fuser belt based architecture. For example, fuser assembly 120 may be a hot roll fuser, including a heated roll and a backup roll engaged therewith to form a fuser nip through which media sheets traverse.

Heating member 202 and backup roll 204 of fuser assembly 120 may be dimensioned to suitably fuse toner on sheets of media having a wide range of widths. As described above, when printing on media sheets having widths that are narrower than the widest sheet width on which image forming device 100 is capable of printing (hereinafter "narrower media sheet"), heat appearing on the portion of backup roll 204 and belt 210 which does not contact the narrower media sheet is not removed thereby, resulting in either such portion of backup roll 204 and belt 210 becoming overheated during a printing operation or requiring the process speed be substantially slowed. According to example embodiments, fuser assembly 120 may include a heat transfer mechanism for transferring excess heat from the portion of backup roll 204 and belt 210 which does not contact narrower media sheets.

Figure 3:
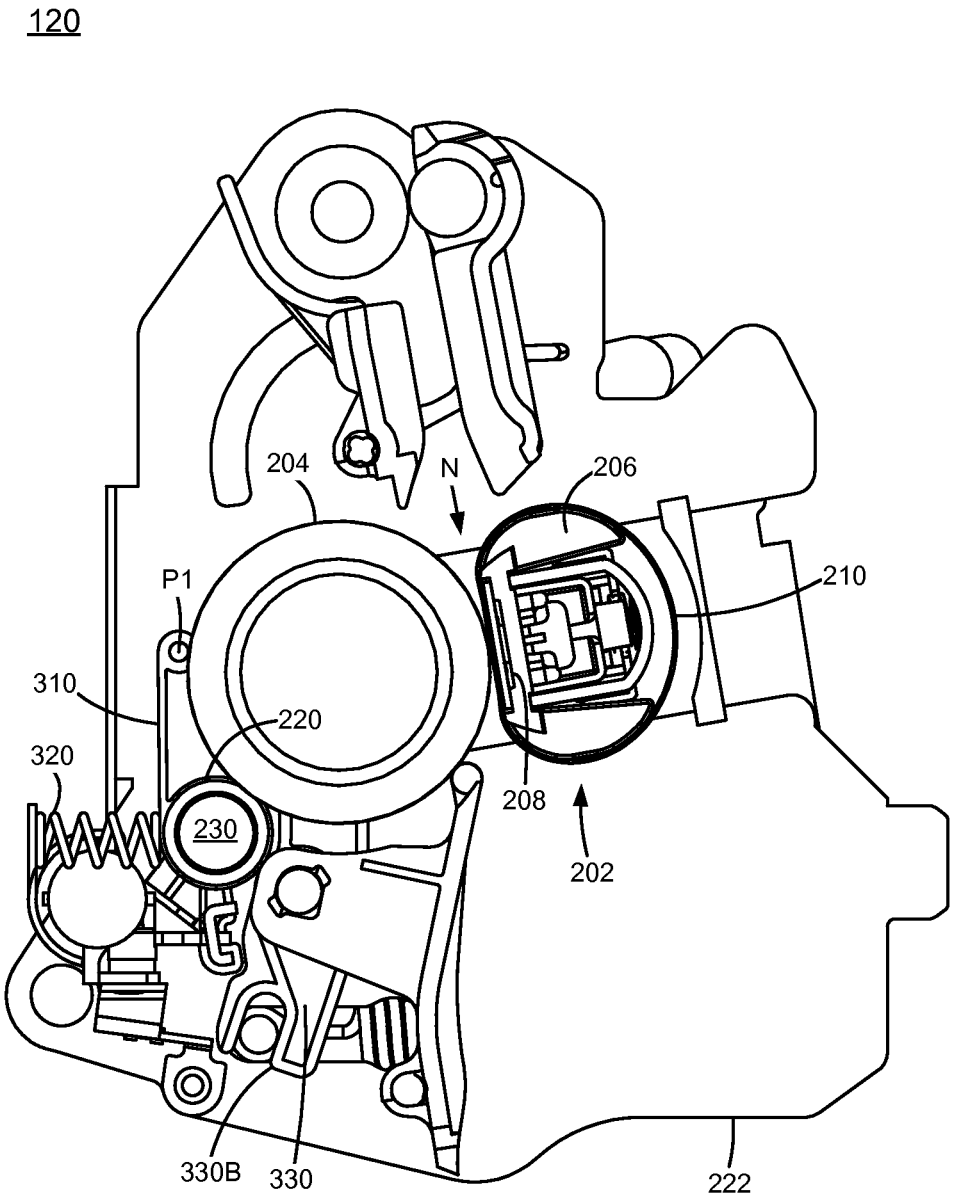
FIG. 3 is a side view of a fuser assembly of FIG. 1 according to another example embodiment.
Figure 6:
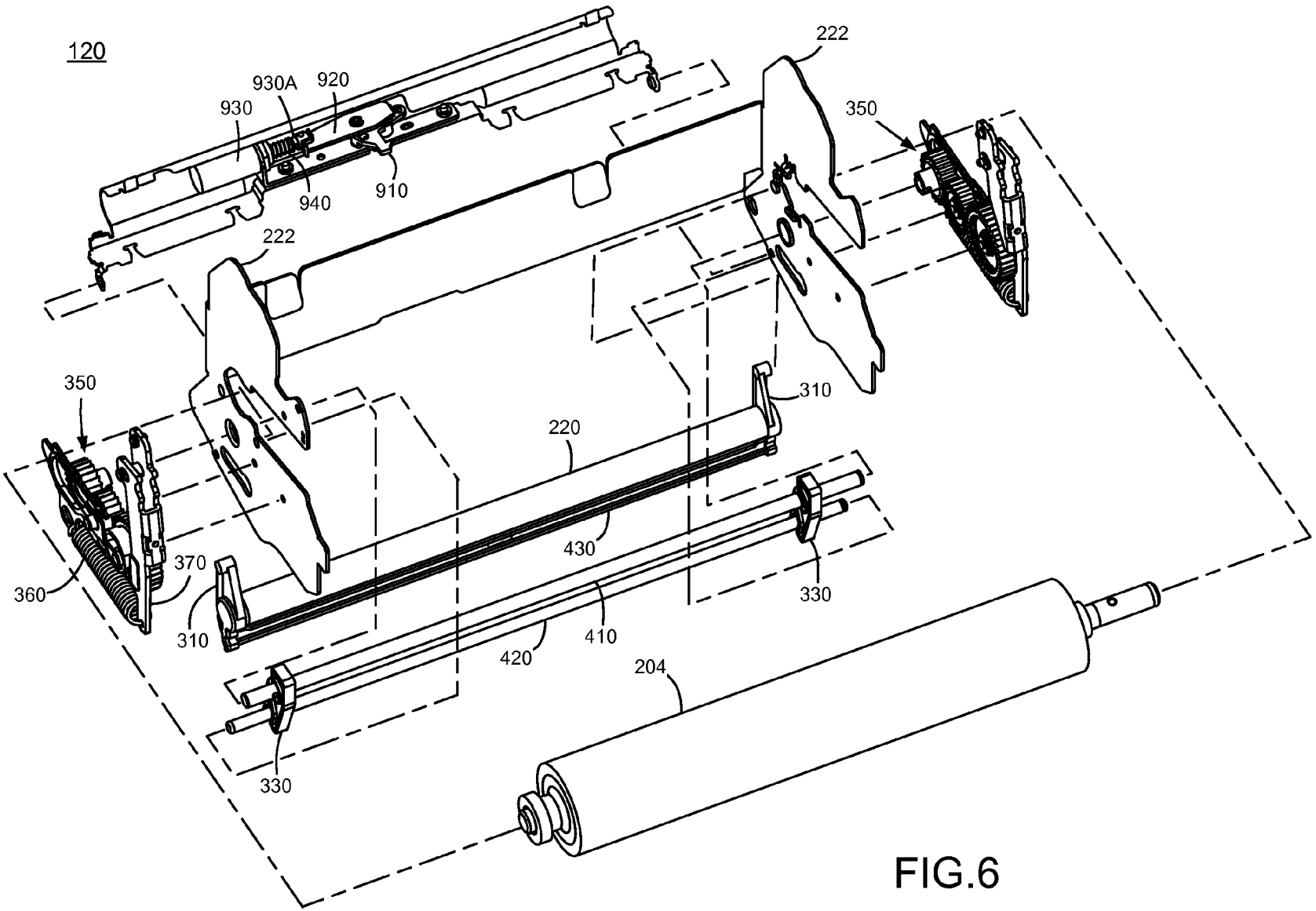
FIG. 6 is an exploded perspective view of the fuser assembly of FIG. 3.

Referring to FIGS. 2 and 3, the heat transfer mechanism may include a roll 220 which contacts backup roll 204 and rotates therewith. Roll 220 may be constructed from a metal, such as aluminum, but it is understood that roll 220 may be constructed from other metals and/or from other thermally conductive materials. Roll 220 may be relatively thin, between about 1.0 mm and 3.0 mm, and particularly between 1.5 mm and 2.0 mm, such as about 1.75 mm Roll 220 may substantially extend the entire width of backup roll 204, but it is understood that roll 220 may be wider or less wide than backup roll 204. In an example embodiment, roll 220 has an outer diameter between about 10 mm and about 15 mm. As shown in FIG. 6, roll 220 may be mounted between side panels 222 of fuser assembly 120. Side panels 222 may form a housing for fuser assembly 120 within which components thereof are disposed. Roll 220 may include a PFA coating along its outer surface to prevent contamination from toner particles.

Figure 4:
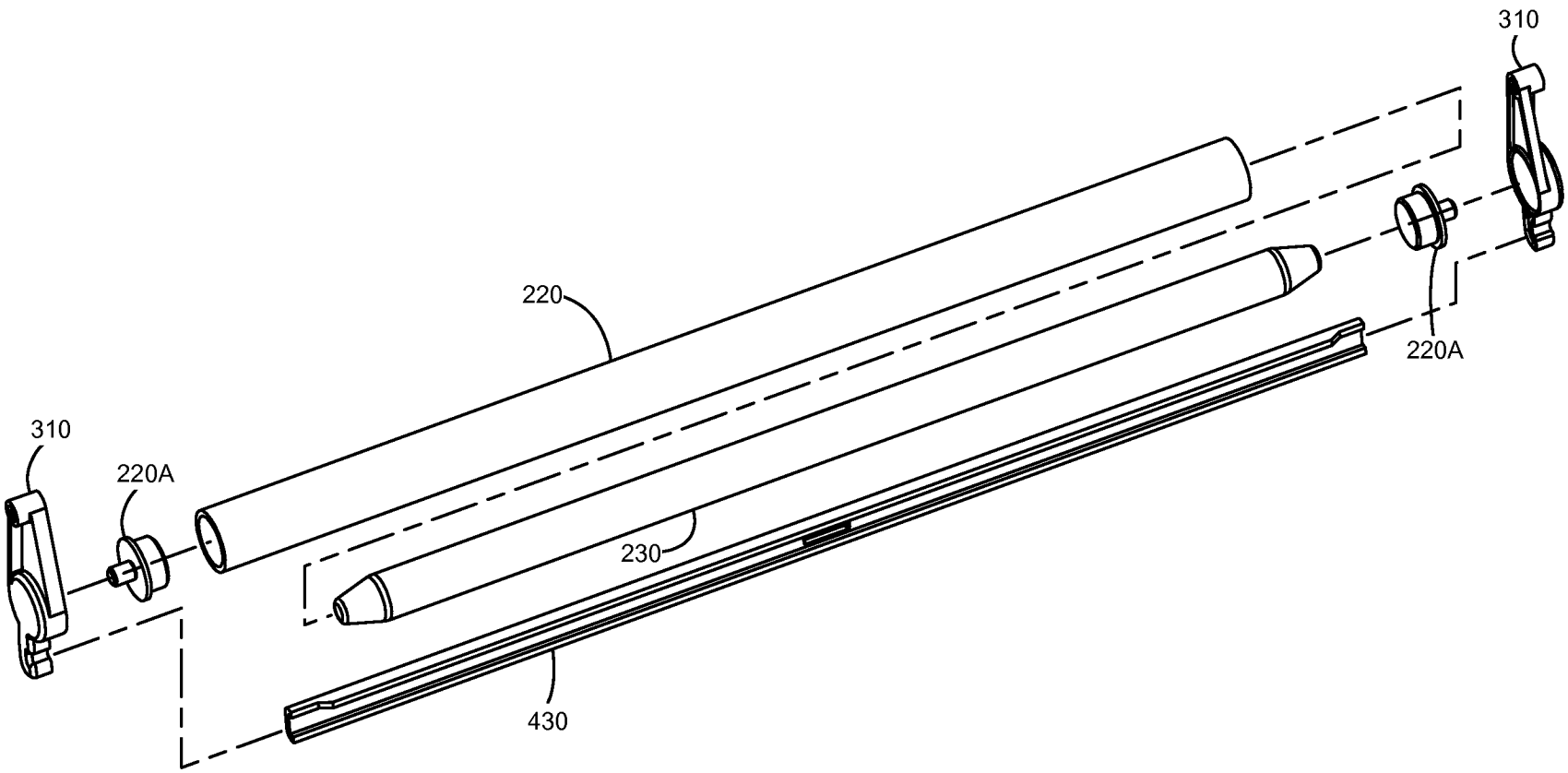
FIG. 4 is an exploded perspective view of a roll appearing in the fuser assemblies of FIGS. 2 and 3, according to an example embodiment.

Referring to FIG. 4, the heat transfer mechanism may further include a heat pipe 230. Heat pipe 230 may be disposed and sealed within roll 220. Heat pipes are known to transfer heat using thermal conductivity and phase transition. In general terms, heat pipe 230 may include a vessel in which its inner walls are lined with a wick structure. When the heat pipe is heated at one end, the working fluid therein evaporates and changes phase from liquid to vapor. The vapor travels through the hollow core of the heat pipe to the opposed end thereof, where the vapor condenses back to liquid and releases heat at the same time. The liquid then travels back to the original end of the heat pipe via the wick structure by capillary action and is then available to repeat the heat transfer process. Heat pipe 230 may have an outer diameter slightly less than the inner diameter of roll 220, such as between about 9 mm and about 10 mm, and particularly about 10.5 mm. A thermal grease or gel may be disposed within the roll 220 between the inner surface thereof and the outer surface of heat pipe 230 for providing improved thermal conductivity between roll 220 and heat pipe 230. Roll 220 may include cap members 220A disposed at each end thereof, for maintaining heat pipe 230 within roll 220.

With roll 220 contacting backup roll 204 and rotating therewith, excess heat appearing on the portion of backup roll 204 which does not contact narrower media sheets is transferred therefrom, with the excess heat first passing through roll 220 to heat pipe 230 and then being transferred to the portion of backup roll 204 which contacts the media sheets. By transferring heat from an overheated portion of backup roll 204 to the portion contacting media sheets, not only is the portion of backup roll 204 which does not contact the narrower media sheet sufficiently maintained within an acceptable operating temperature range but also less energy may be needed to heat the portion of backup roll which contacts the narrower media sheet.

In an example embodiment roll 220 is disposed to contact backup roll 204 and rotate therewith. This is illustrated in FIG. 2 in which there is continuous contact between backup roll 204 and roll 220.

In another example embodiment, roll 220 is movable between a first position in which roll 220 contacts backup roll 204 and rotates therewith, and a second position in which roll 220 does not contact backup roll 204. Specifically, fuser assembly 120 may include a positioning mechanism for moving roll 220 between the first and second positions. In one example embodiment, the positioning mechanism pivots roll 220 into and out of contact with backup roll 204. Referring to FIGS. 3 and 5-9, the positioning mechanism may include bell cranks 310, each of which has a first end rotatably connected to a side panel 222. In this way, each bell crank 310 can pivot about pivot point P1 (best seen in FIGS. 3, 7A-7B and 8A-8B). Each end of roll 220 is rotatably connected to a bell crank 310 via bearings, bushings or the like so that roll 220 is capable of rotating about its longitudinal axis. The rotation of bell cranks 310 about their pivot points P1 rotates roll 220 about same so that roll 220 is movable between the above-described first and second positions.

The positioning mechanism may further include a first bias member 320 (FIG. 3) having a first end connected to bell crank 310 at a location thereon that is a distance from pivot point P1, and a second end connected to a stable, unmoving portion of fuser assembly 120, such as the housing thereof. Bias member 320, which may be a compression spring, urges bell crank 310 in a direction, such as counter-clockwise as appearing in FIGS. 3, 7A-7B and 8A-8B, so that roll 220 moves towards backup roll 204 until roll 220 makes contact therewith. It is understood that bias member 320 may be implemented using other types of springs or biasing mechanisms.

Figure 8A:
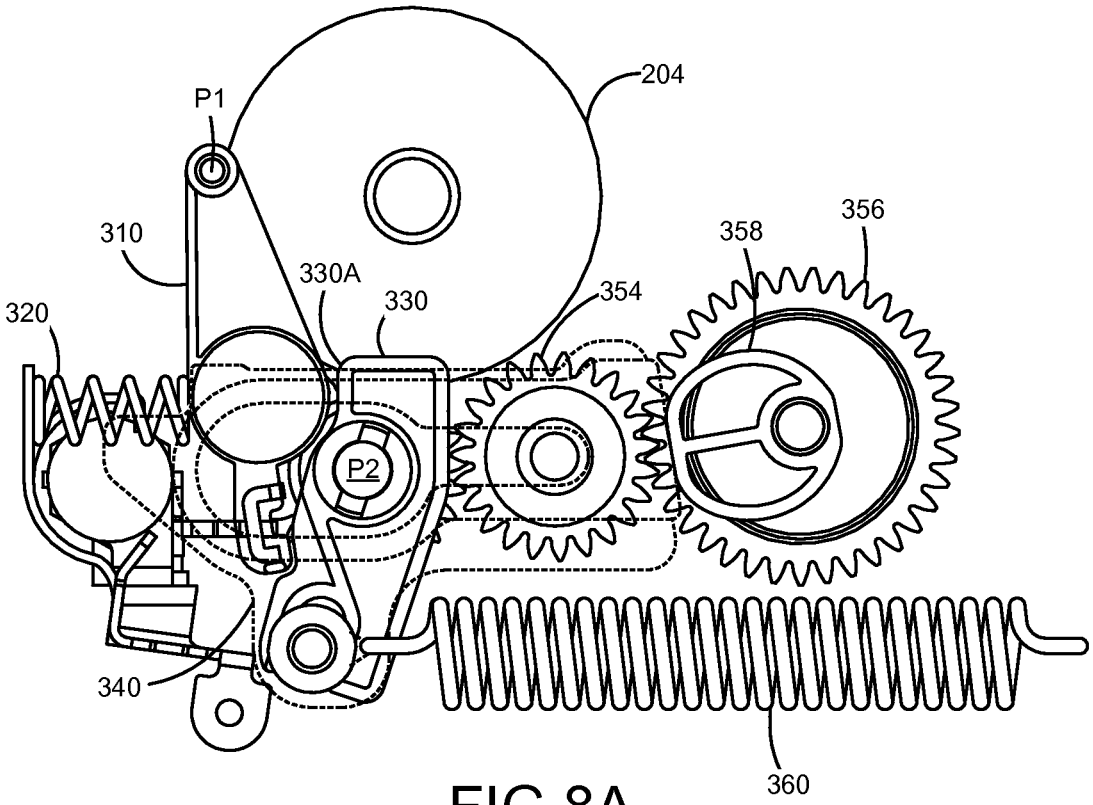
FIGS. 8A and 8B are additional side cross sectional views of the fuser assembly of FIG. 3.
Figure 8B:
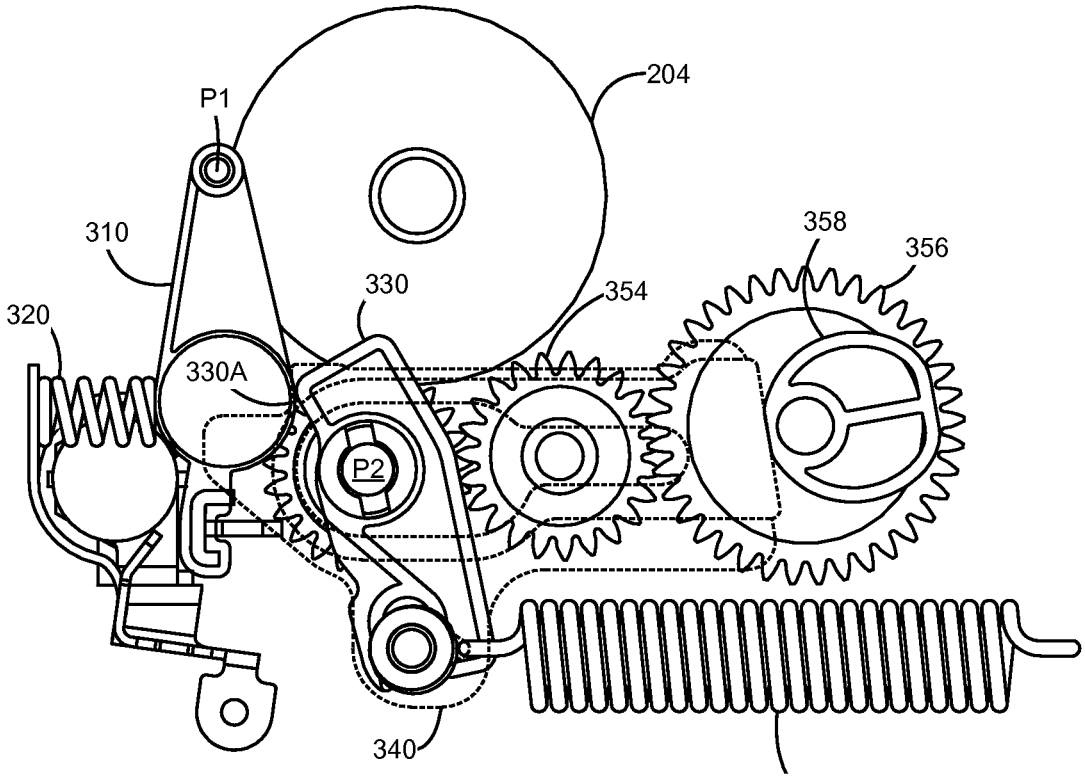

The positioning mechanism for moving roll 220 into and out of contact with backup roll 204 may further include first coupling members 330, each of which may be positioned to engage with a bell crank 310. Referring to FIGS. 8A and 8B, each first coupling member 330 may be pivotally attached within fuser assembly 120, such as via connection to side panels 222, and pivot about pivot point P2. A first portion 330A of first coupling member 330 may contact bell crank 310 such that rotational movement of first coupling member 330 causes bell crank 310 to rotate. For example, rotation of first coupling member 330 in the counter-clockwise direction (as viewed from FIGS. 8A-8B) about pivot point P2 causes bell crank 310 to rotate about pivot point P1 in the clockwise direction. Each first coupling member 330 may include a forked end portion 330B.

Figure 7A:
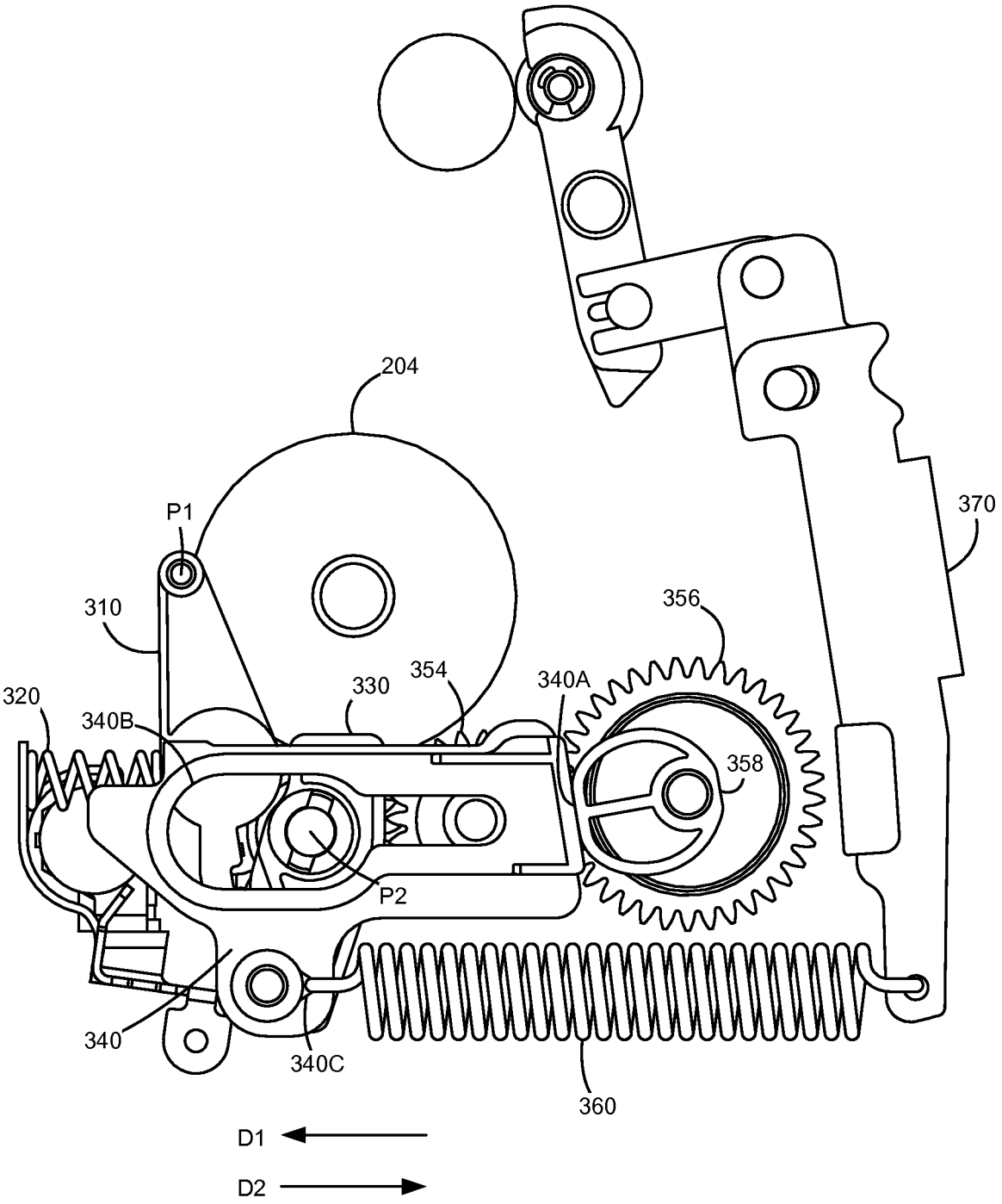
FIGS. 7A and 7B are side cross sectional views of the fuser assembly of FIG. 3.
Figure 7B:
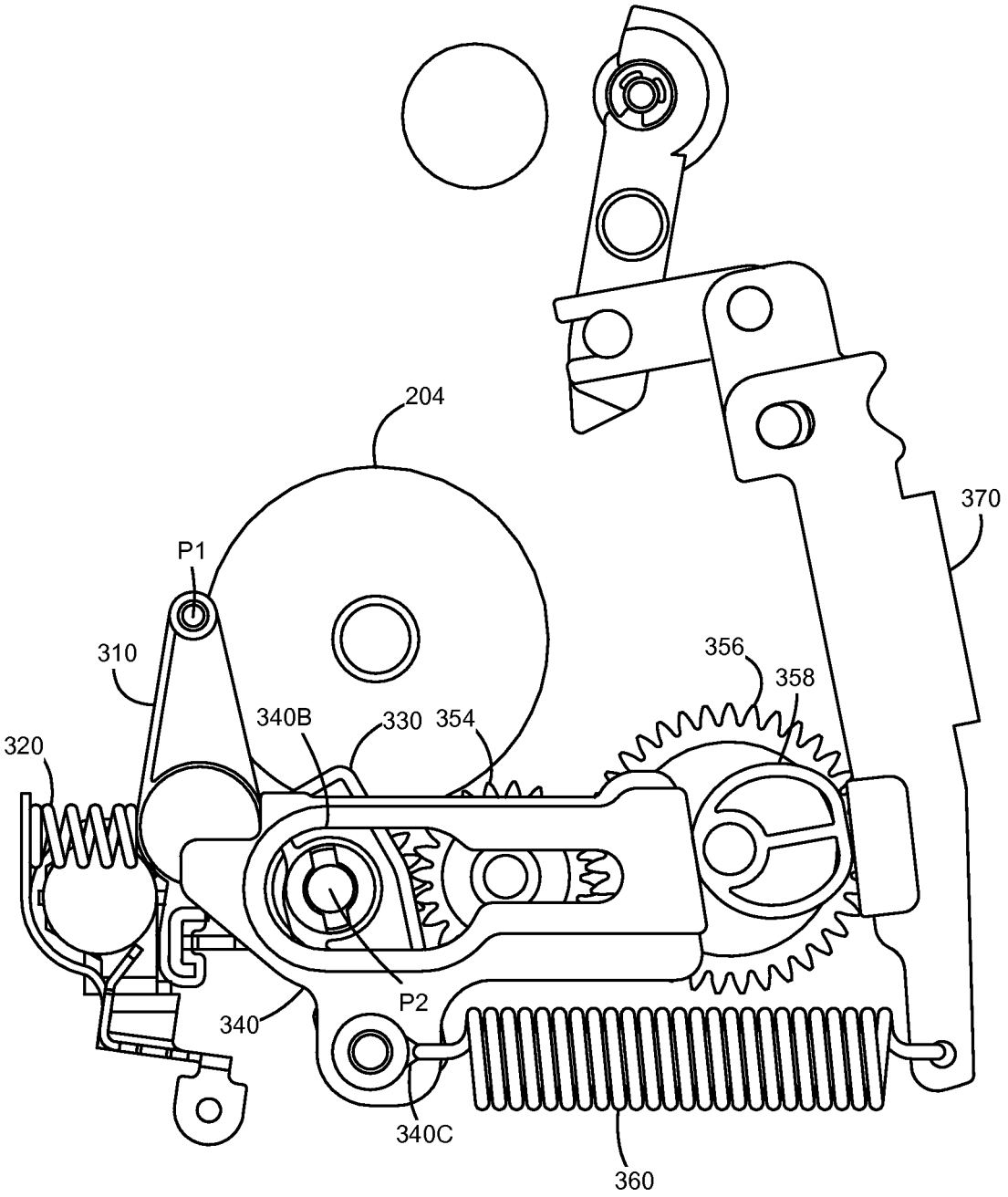

The positioning mechanism may further include second coupling members 340, each of which engages with a first coupling member 330. Referring to FIGS. 7A and 7B, each second coupling member 340 is translatable within fuser assembly 120. By way of one example, each second coupling member 340 slidingly engages along a track (not shown) within fuser assembly 120. Best seen in FIGS. 5 and 7A-7B, second coupling member 340 may include a contact surface 340A which, when a force is applied thereto, causes second coupling member 340 to translate. Each second coupling member 340 may further include at least one slot 340B defined along the longitudinal direction thereof. Slot 340B may be sufficiently sized for allowing gears and/or other components to extend therethrough without second coupling member 340 interfering with them as second coupling member 340 moves within fuser assembly 120. Further, each second coupling member 340 may include an aperture 340C for receiving other components of the positioning mechanism.

With reference to FIGS. 5, 6, 7A-7B and 8A-8B, the positioning mechanism includes one or more gear assemblies 350. Each gear assembly 350 may include a drive gear 352; an idler gear 354 which engages with drive gear 352; and driven gear 356 which engages with idler gear 354. Rotation of drive gear 352 causes idler gear 354 to rotate in an opposite direction and driven gear 356 to rotate in the same direction as drive gear 352. Mounted on driven gear 356 is a cam 358. Cam 358 rotates with driven gear 356. The outer surface of cam 358 engages with contact surface 340A of second coupling member 340. Rotation of cam 358 results in the distance between contact surface 340A and the rotational axis of driven gear 356 varying. This varying distance results in second coupling member 340 translating in directions indicated by arrows D1 and D2 in FIG. 7A.

The positioning mechanism of fuser assembly 120 may further include a second bias member 360 having a first end which engages with aperture 340C of second coupling member 340 and a second end which engages with pivoting arm 370 (FIGS. 7A and 7B) which itself contacts the outer surface of cam 358 and is moved thereby. Second bias member 360, which may be a tension spring, presents a bias force on second coupling member 340 to urge second coupling member 340 towards cam 358 so as to maintain contact therewith.

As shown in the FIGS. 6, 7A-7B and 8A-8B, each end of roll 220 is coupled to a bell crank 310, a first bias member 320, a first coupling member 330, a second coupling member 340, a gear assembly 350, and a second bias member 360. The positioning mechanism may couple together some of the above components at opposed ends of roll 220 so that the components at each end of roll 220 act substantially in unison. According to an example embodiment, the positioning mechanism further includes a first shaft 410 (see FIGS. 5 and 6) which is coupled between side panels 222. First shaft 410 provides the pivot points P2 about which first coupling members 330 rotate. First shaft 410 is also coupled to drive gear 352 such that rotation of first shaft 410 causes drive gears 352 to rotate. The positioning mechanism may further include a second shaft 420 (FIGS. 5 and 6) disposed between side panels 222. The forked end portion 330B of each first coupling member 330 engages with second shaft 420. In addition, second shaft 420 may extend through aperture 340C of each second coupling member 340. In this way, first coupling members 330 rotate substantially in unison.

Figure 5:
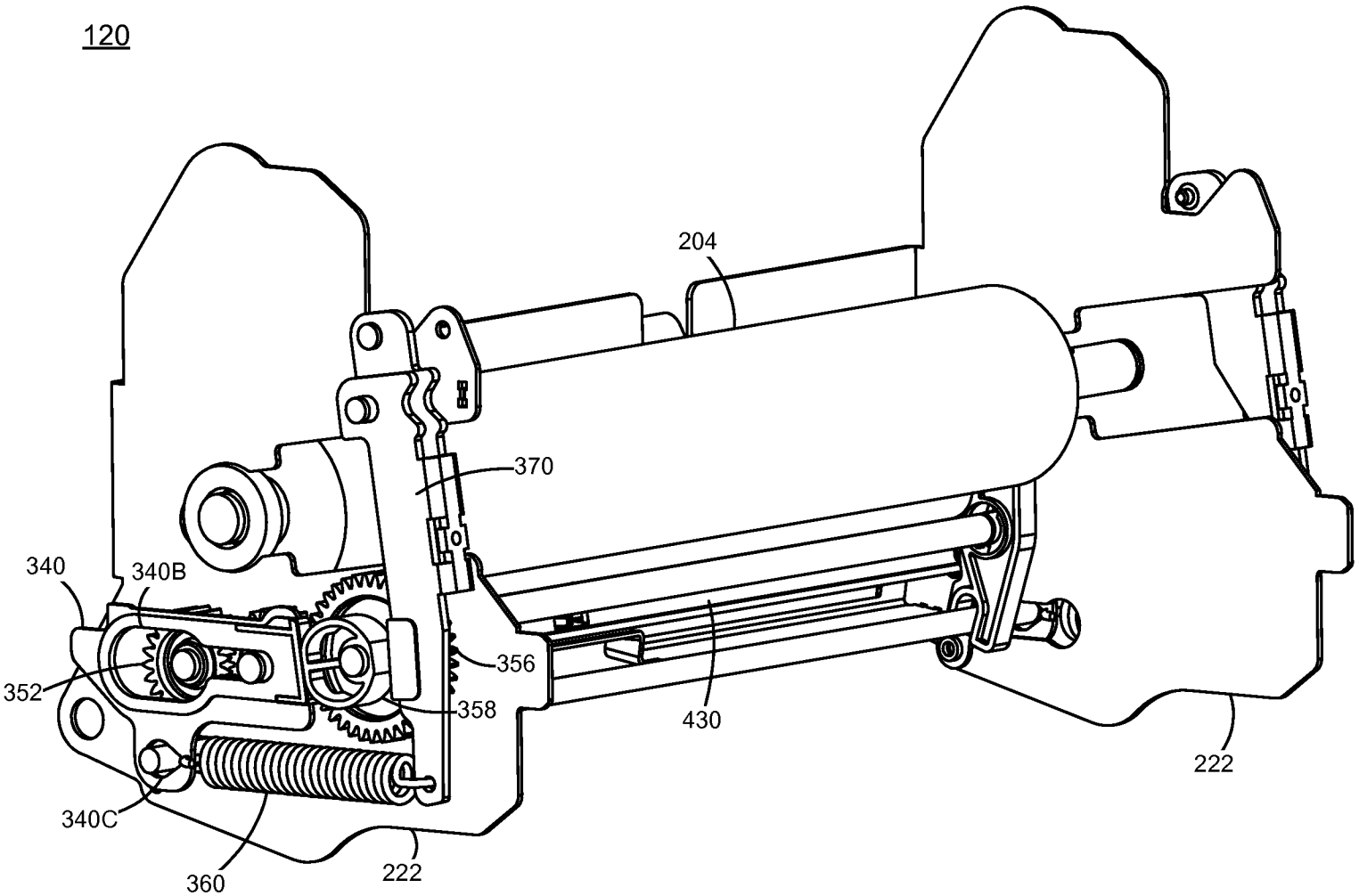
FIG. 5 is a perspective view of the fuser assembly of FIG. 3.

In addition, the positioning mechanism may include a crossbar member 430. As illustrated in FIGS. 4-6, crossbar member 430 is disposed between and coupled to each bell crank 310 at a spaced distance from pivot point P1. Crossbar member 430 allows for bell cranks 310 to move substantially in unison.

Figure 9:
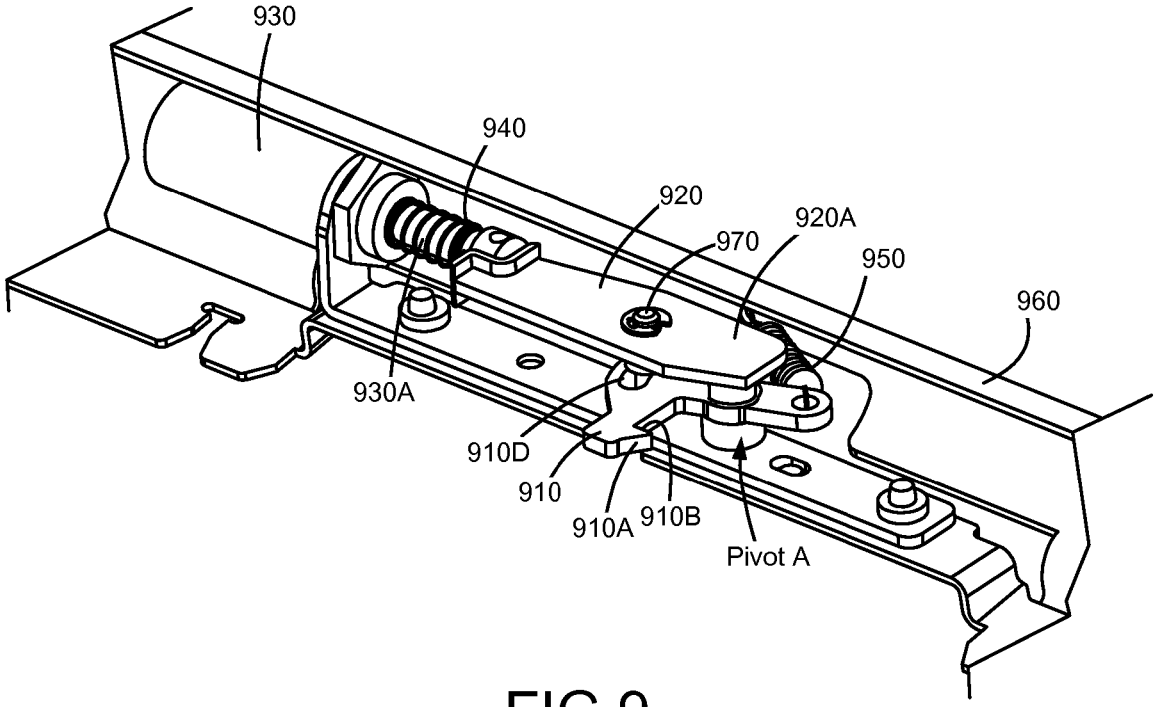
FIG. 9 is a perspective view of a latching mechanism of the fuser assembly of FIG. 3.
Figure 10:
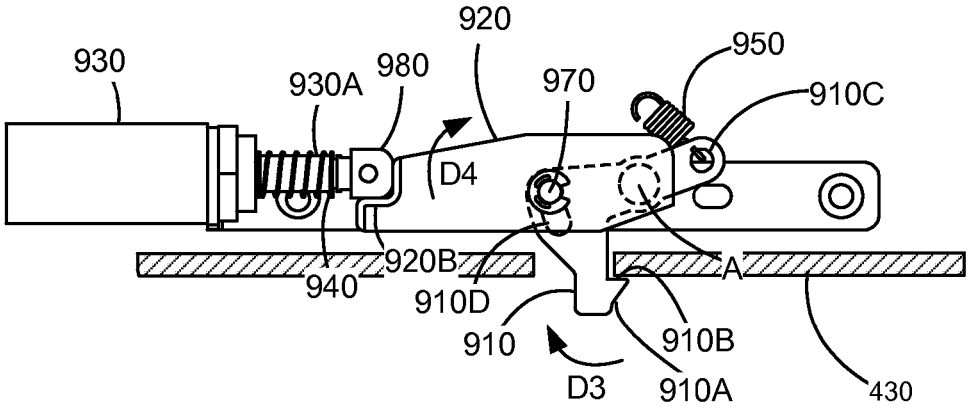
FIG. 10 is a side elevational view of the latching mechanism of FIG. 9.

Fuser assembly 120 may include a latching mechanism for latching roll 220 in the second position, spaced from backup roll 204. Referring to FIGS. 9 and 10, and according to an example embodiment, the latching mechanism includes a first member 910 which selectively engages with crossbar member 430 for latching same at a spaced distance from backup roll 204; a second member 920 which cooperates with first member 910 for maintaining a latched engagement between first member 910 and crossbar member 430; a solenoid 930 having plunger 930A for selectively controlling the release of crossbar member 430 from first member 910; bias member 940 which positions plunger 930A when solenoid 930 is de-energized; and bias member 950 which is coupled to first member 910 for positioning first member 910 when first member 910 is not engaged with crossbar member 430.

As shown in FIGS. 9 and 10, first member 910 is generally L-shaped including sloped surface 910A disposed along one end portion of first member 910 with ledge 910B. Sloped surface 910A and ledge 910B of first member 910 contact crossbar member 430 for latching same at a distance from backup roll 204. A second end portion of first member 910 includes an aperture 910C to which one end of bias member 950 is attached. A second end of bias member 950 may be coupled to frame 960 of fuser assembly 120. First member 910 further includes a curved slot 910D.

Second member 920 is generally elongated having a first end portion which is pivotably coupled to first member 910 and a second end portion which engages with plunger 930A of solenoid 930. Specifically, second member 920 may include an extension 920A (best seen in FIG. 9) which extends in a generally orthogonal direction from a longitudinal direction of second member 920 and forms the pivotal coupling with first member 910 at pivot point A. First member 910 may likewise include an extension which extends toward second member 920 and/or otherwise engages with extension 920A to form the pivotal connection between first member 910 and second member 920. The second end portion of second member 920 includes a cradle 920B which is sized and dimensioned for receiving an end of plunger 930A. Further, second member 920 is rotatably connected to a frame 960 of fuser assembly 120 and is rotatable about pivot post 970, which itself is fixed relative to frame 960. Pivot post 970 is disposed within slot 910D of first member 910 so that movement of first member 910 is at least partly defined by movement of slot 910D relative to pivot post 970. FIG. 10 illustrates the direction of rotational movement of each of first member 910 and second member 920 from their respective positions in the drawing.

Solenoid 930 is disposed along frame 960 of fuser assembly 120. Solenoid 930 includes a winding and control wires (not shown) for energizing and de-energizing same. When solenoid 930 is energized, solenoid plunger 930A moves away from second member 920. When solenoid 930 is de-energized, bias member 940 urges plunger 930A towards second member 920 until contact is made therewith. A cap 980 may be placed over the distal end of plunger 930A to reduce friction between solenoid plunger 930A and second member 920. Solenoid 930 may be controlled by controller 140.

It is understood that devices other than solenoid 930 may be used, such as a servo.

As mentioned, controller 140 controls fuser assembly 120. Specifically, controller 140 may control the position of roll 220 relative to backup roll 204. For example, when controller 140 determines that a portion of heater element 208, backup roll 204 and/or fuser belt 210 are or will be at a temperature above an acceptable fuser temperature range, which may be due to printing on narrower media sheets, controller 140 may control fuser assembly 120 so that roll 220, having heat pipe 230 therein, is positioned against backup roll 204. Controller 140 may make this determination by measuring the temperature of heater element 208 or backup roll 204, or determining that narrow media will be used in an upcoming print job from user input or sensing media sheet width within an input tray or in the media path. When roll 220 is in contact with backup roll 204, heat pipe 230 transfers heat from the portion of backup roll 204 that is above the acceptable temperature range to a second portion of backup roll 204 which is at a lower temperature. When controller 140 determines that heater element 208, backup roll 204 and/or fuser belt 210 are at an acceptable fusing temperature, controller 140 may control fuser assembly 120 so that roll 220 no longer contacts backup roll 204.

The operation of fuser assembly 120 will be described with reference to FIGS. 7A-7B, 8A-8B and 9-10. As mentioned, when controller 140 determines that a portion of at least one component of fuser assembly 120, such as backup roll 204, is or will soon become overheated, i.e., above an acceptable temperature range for operating, controller 140 will cause drive gear 352 to rotate so that cam 358 is positioned as shown in FIGS. 7A and 8A. Drive gear 352 may be rotated by rotating first shaft 410 using a motor or the like that is external to fuser assembly 120. As cam 358 is rotated to this position, cam 358 moves and/or translates second coupling member 340 in direction D1 (see FIG. 7A), which causes first coupling member 330 to rotate (clockwise as seen in FIG. 8A) due to the coupling between first coupling member 330 and second coupling member 340 via second shaft 420. Rotation of first coupling member 330 causes first portion 330A of first coupling member 330 to rotate away from its corresponding bell crank 310, thereby allowing bell crank 310 to rotate about pivot point P1 (counterclockwise in FIGS. 7A and 8A) due to the bias force by first bias member 320, until roll 220 contacts backup roll 204. With roll 220 in contact with backup roll 204 and rotatable therewith, during a fusing operation heat pipe 230 transfers excess heat from a hotter portion of backup roll 204 to another portion having a lesser temperature.

When controller 140 determines that backup roll 204 is or will soon be within the acceptable temperature range for a fusing operation, controller 140 will cause drive gear 352 to rotate so that cam 358 is positioned as shown in FIGS. 7B and 8B. As cam 358 is rotated to this position, second coupling member 340 is moved in a direction D2 (FIG. 7B) opposite to direction D1, which causes first coupling member 330 to rotate (counterclockwise in FIG. 8B) so that first portion 330A of first coupling member 330 urges its corresponding bell crank 310 to rotate roll 220 away from backup roll 204 (clockwise in FIG. 8B) until roll 220 no longer contacts backup roll 204. In the event the fuser nip N was previously opened, following nip closure fuser assembly 120 may perform a fusing operation without use of heat pipe 230 to transfer heat from one portion thereof to a second portion. Further, bell cranks 310 may be rotated until crossbar member 430 contacts sloped surface 910A of first member 910. Continued movement of crossbar member 430 causes first member 910 to rotate about pivot point A in a clockwise direction D3 as viewed from FIG. 10. During this time, second member 920 does not rotate about pivot post 970 and is positioned generally as shown in FIGS. 9 and 10 because solenoid 930 is de-energized so that bias member 940 urges plunger 930A to contact cradle 920B of second member 920. Rotation of first member 910 about pivot point A is guided in part by slot 910D of first member 910 moving relative to pivot post 970. First member 910 continues to rotate in a clockwise direction while crossbar member 430 engages with sloped surface 910A and moves towards an outer edge thereof. Further movement of crossbar member 430 beyond the outer edge of sloped surface 910A causes first member 910 to rotate counterclockwise about pivot point A (as viewed from FIG. 10) due to a bias force applied by bias member 950, resulting in crossbar member 430 contacting ledge 910B of first member 910.

During this time, first bias members 320 urge crossbar member 430 against ledge 910B with a force (downward as viewed in FIG. 10). With pivot post 970 positioned in the upper end of slot 910D so as to prevent rotational movement of first member 910 in the counterclockwise direction, the force applied to first member 910 pulls against pivot point A which would cause second member 920 to rotate clockwise about pivot post 970. However, with solenoid de-energized and solenoid plunger 930A positioned by bias member 940 so that the distal end thereof contacts cradle 920B of second member 920, second member 920 is prevented from rotational movement. Without movement of first member 910 and second member 920, crossbar member 430 remains latched so that roll 220 continues to be spaced from backup roll 204.

When controller 140 later determines that heat pipe 230 is needed during a fusing operation for fusing toner to narrow media, controller 140 positions cam 358 as shown in FIGS. 7A and 8A and energizes solenoid 930 which draws the distal end of solenoid plunger 930A away from cradle 920B of second member 920 so as to disengage therefrom. With the above-mentioned bias force from first bias member 320 remaining present, such disengagement allows second member 920 to rotate about pivot post 970 in a clockwise direction D4 (relative to the view of FIG. 10). First member 910 rotates in a clockwise direction with second member 920 about pivot post 970, with substantially no movement relative to second member 920. Sufficient rotational movement of first member 910 results in ledge 910B disengaging from crossbar member 430 at which point first bias members 320 urge crossbar member 430, and with it roll 220, towards backup roll 204 until roll 220 makes contact therewith. At that point, a fusing operation may be performed on narrow media using heat pipe 230.

Figure 11:
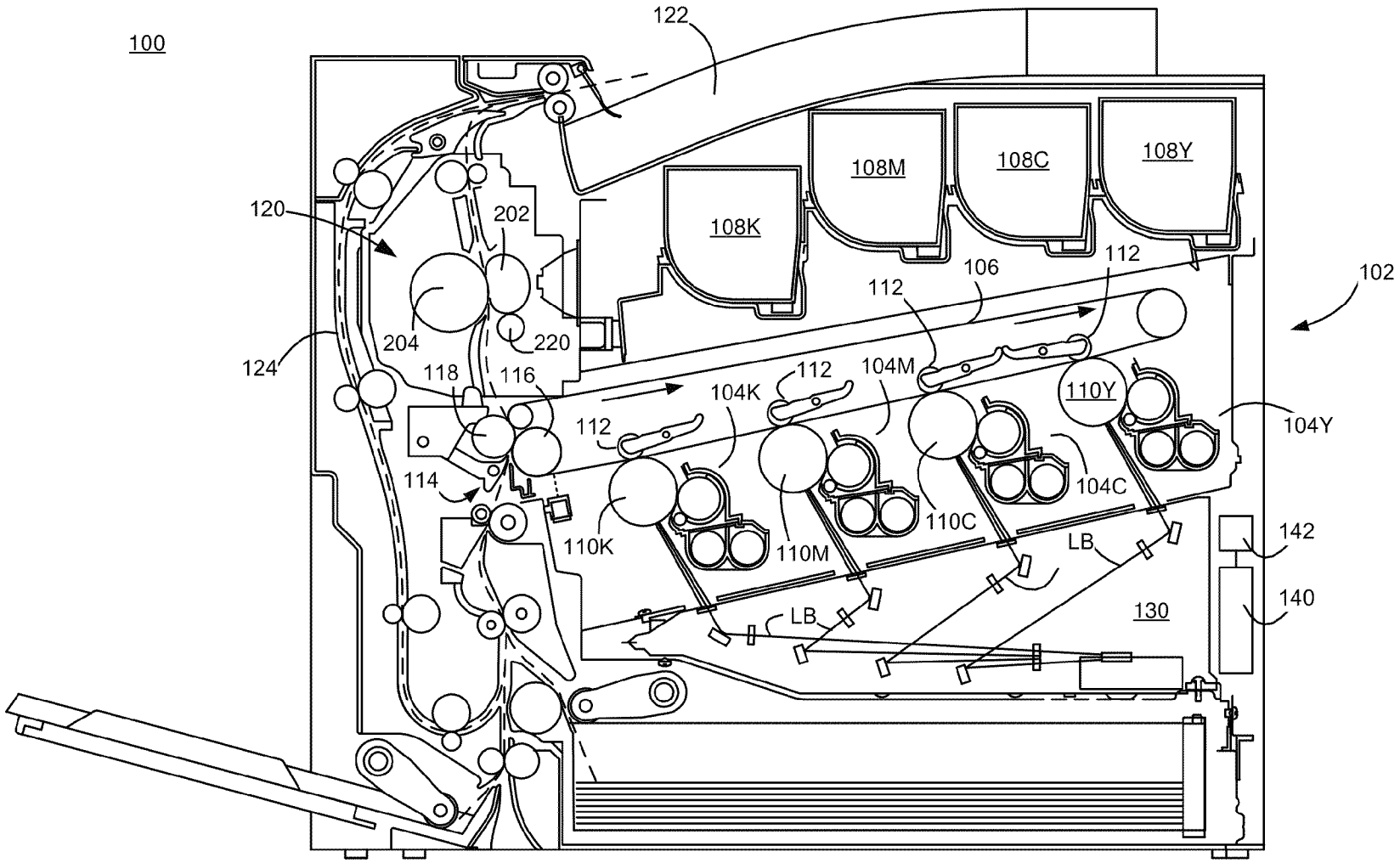
FIG. 11 is a side elevational view of an image forming apparatus according to another example embodiment.

The example embodiments described above describe roll 220 in contact with backup roll 204. It is understood that roll 220 may instead contact fuser belt 210 of heating member 202, as shown in FIG. 11. In the event fuser assembly 120 utilizes a hot roll architecture, i.e., heating member 202 is a hot roll, roll 220 may be configured to contact the hot roll.

In addition, the example embodiments are described as controller 140 being separate from but communicatively coupled to fuser assembly 120. In an alternative embodiment, controller 140 is mounted on or within fuser assembly 120 and may form part thereof.

The description of the details of the example embodiments have been described in the context of a color electrophotographic imaging devices. However, it will be appreciated that the teachings and concepts provided herein are applicable to monochrome electrophotographic imaging devices and multifunction products employing electrophotographic imaging.

The foregoing description of several example embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A fuser assembly for fusing toner to sheets of media, comprising:

a housing;

a heating member;

a backup roll disposed proximate to the heating member so as to form a fuser nip therewith; and a heat transfer device for selectively contacting one of the backup roll and the heating member such that rotation of the one of the backup roll and the heating member rotates the heat transfer device, wherein when the heat transfer device contacts the one of the backup roll and the heating member, the heat transfer device transfers heat from one location on the one of the backup roll and the heating member to a second location thereon; and a positioning mechanism coupling the heat transfer device to the housing, the positioning mechanism moving the heat transfer device between a first position in which the heat transfer device is engaged with and contacts the one of the backup roll and the heating member and a second position in which the heat transfer device is disengaged and spaced apart therefrom, the positioning mechanism pivots the heat transfer device about a pivot axis when moving between the first and second positions, wherein the positioning mechanism comprises:

a pair of bell cranks, each bell crank having a first end portion pivotably coupled to the housing at a pivot point and a second end portion to which an end of the heat transfer device is coupled, wherein the pivot points of the bell cranks define the pivot axis about which the heat transfer device pivots when moving between the first and second positions;

a second coupling member coupled to at least one of the bell cranks, translation of the second coupling member in a substantially linear direction causing the bell cranks to pivot for moving the heat transfer device between the first and second positions;

a cam member that is rotatable, wherein rotation of the cam member causes the second coupling member to translate in the substantially linear direction and the at least one of the bell cranks to rotate;

a first coupling member coupled between the second coupling member and the at least one of the bell cranks, the first coupling member moving in response to rotation of the cam member and imparting rotation to the at least one of the bell cranks, wherein the second coupling member is coupled between the cam member and the first coupling member, the second coupling member contacting the cam member and translating in response to rotation thereof, the second coupling member translating causing the first coupling member to move; and a bias member coupled to the second coupling member to urge the second coupling member against the cam member and maintain contact therewith, the bias member being directly connected to the second coupling member.

2. The fuser assembly of claim 1, wherein the positioning mechanism further comprises:

an additional first coupling member, each first coupling member having a first end portion which contacts the second end portion of a corresponding bell crank and a second end portion, each first coupling member being rotatable about a pivot point; and an additional second coupling member, each second coupling member being coupled to the second end portion of a corresponding first coupling member such that movement of the second coupling member causes the corresponding first coupling member to rotate about the pivot point thereof.

3. The fuser assembly of claim 2, wherein the positioning mechanism further comprises an additional cam member, each cam member being coupled to a corresponding second coupling member such that rotation of the cam member causes the corresponding second coupling member to move.

4. The fuser assembly of claim 3, further comprising a plurality of gear assemblies, each gear assembly coupled to one of the cam members, wherein rotation of one or more gears in each gear assembly causes the corresponding cam member coupled thereto to rotate.

5. The fuser assembly of claim 1, wherein the positioning mechanism further comprises a pair of second bias members, each second bias member being coupled between the housing and a corresponding bell crank so as to urge the bell crank to move the heat transfer device towards the first position.

6. A toner fusing apparatus, comprising:

a housing;

a heating member;

a backup roll disposed proximate to the heating member so as to form a fuser nip therewith for fusing toner to sheets of media;

a heat transfer device for selectively contacting one of the backup roll and the heating member such that rotation of the one of the backup roll and the heating member rotates the heat transfer device, wherein when the heat transfer device contacts the one of the backup roll and the heating member, the heat transfer device transfers heat from one location on the one of the backup roll and the heating member to a second location thereon; and a positioning mechanism coupling the heat transfer device to the housing, the positioning mechanism moving the heat transfer device between a first position in which the heat transfer device is engaged with and contacts the one of the backup roll and the heating member and a second position in which the heat transfer device is disengaged and spaced apart therefrom, the positioning mechanism comprises at least one cam member coupled to the heat transfer device, wherein rotation of the at least one cam member causes the heat transfer device to move from the first position to the second position, wherein the positioning mechanism further comprises at least one first coupling member and at least one second coupling member, the at least one first coupling member and the at least one second coupling member coupled between the at least one cam member and the heat transfer device, each at least one first coupling member rotates about a pivot point and each at least one second coupling member moves in a substantially linear direction in response to rotation of the at least one cam member;

a plurality of bell cranks, each of the plurality of bell cranks rotatably coupled to the housing and to the heat transfer device, the at least one cam member being coupled to the plurality of bell cranks via the at least one first coupling member and the at least one second coupling member such that rotation of the at least one cam member causes the plurality of bell cranks to rotate and the heat transfer device to rotate between the first and second positions, wherein each of the at least one first coupling member is coupled to a corresponding bell crank and to the at least one cam member such that rotation of the at least one cam member causes the at least one first coupling member to move which causes the corresponding bell crank to move the heat transfer device between the first and second positions, and each of the at least one second coupling member is coupled between the at least one first coupling member and the at least one cam member such that rotation of the at least one cam member causes the at least one second coupling member to move, the at least one second coupling member moving causes the at least one first coupling member to move; and at least one bias member having a first end and a second end coupled to the at least one second coupling member so as to maintain contact between the at least one second coupling member and the at least one cam member.

7. The toner fusing apparatus of claim 6, wherein the positioning mechanism further comprises at least one second bias member coupled between the housing and at least one of the bell cranks, the at least one second bias member urging the bell cranks so that the heat transfer device is urged towards the first position.

8. The toner fusing apparatus of claim 6, wherein the at least one first coupling member comprises a plurality of first coupling members, and the positioning mechanism further comprises a first shaft coupled between the first coupling members so that the first coupling members move substantially in unison.

9. The toner fusing apparatus of claim 6, wherein the positioning mechanism further comprises a crossbar member coupled between the plurality of bell cranks so that the bell cranks move substantially in unison.

10. The toner fusing apparatus of claim 6, further comprising at least one gear assembly coupled to the at least one cam member, wherein rotation of one or more gears in the at least one gear assembly causes the at least one cam member to rotate.

11. A fuser assembly for fusing toner to sheets of media, comprising:

a housing;

a heating member;

a backup roll disposed proximate to the heating member so as to form a fuser nip therewith; and a heat transfer device for selectively contacting one of the backup roll and the heating member such that rotation of the one of the backup roll and the heating member rotates the heat transfer device, wherein when the heat transfer device contacts the one of the backup roll and the heating member, the heat transfer device transfers heat from one location on the one of the backup roll and the heating member to a second location thereon; and a positioning mechanism coupling the heat transfer device to the housing, the positioning mechanism moving the heat transfer device between a first position in which the heat transfer device is engaged with and contacts the one of the backup roll and the heating member and a second position in which the heat transfer device is disengaged and spaced apart therefrom, the positioning mechanism pivots the heat transfer device about a pivot axis when moving between the first and second positions, wherein the positioning mechanism comprises:

a pair of bell cranks, each bell crank having a first end portion pivotably coupled to the housing at a pivot point and a second end portion to which an end of the heat transfer device is coupled, wherein the pivot points of the bell cranks define the pivot axis about which the heat transfer device pivots when moving between the first and second positions;

a second coupling member coupled to at least one of the bell cranks, translation of the second coupling member in a substantially linear direction causing the bell cranks to pivot for moving the heat transfer device between the first and second positions;

a plurality of first coupling members, each first coupling member having a first end portion which contacts the second end portion of a corresponding bell crank and a second end portion, each of the plurality of first coupling members being rotatable about a pivot point;

an additional second coupling member, each second coupling member being coupled to the second end portion of a corresponding first coupling member such that movement of the second coupling member causes the corresponding first coupling member to rotate about the pivot point thereof; and a plurality of cam members, each cam member being coupled to a corresponding second coupling member such that rotation of the cam member causes the corresponding second coupling member to move.

12. The fuser assembly of claim 11, further comprising a plurality of gear assemblies, each gear assembly coupled to one of the cam members, wherein rotation of one or more gears in each gear assembly causes the cam member coupled thereto to rotate.

13. A toner fusing apparatus, comprising:

a housing;

a heating member;

a backup roll disposed proximate to the heating member so as to form a fuser nip therewith for fusing toner to sheets of media;

a heat transfer device for selectively contacting one of the backup roll and the heating member such that rotation of the one of the backup roll and the heating member rotates the heat transfer device, wherein when the heat transfer device contacts the one of the backup roll and the heating member, the heat transfer device transfers heat from one location on the one of the backup roll and the heating member to a second location thereon; and a positioning mechanism coupling the heat transfer device to the housing, the positioning mechanism moving the heat transfer device between a first position in which the heat transfer device is engaged with and contacts the one of the backup roll and the heating member and a second position in which the heat transfer device is disengaged and spaced apart therefrom, the positioning mechanism comprises at least one cam member coupled to the heat transfer device, wherein rotation of the at least one cam member causes the heat transfer device to move from the first position to the second position, wherein the positioning mechanism further comprises at least one first coupling member and at least one second coupling member, the at least one first coupling member and the at least one second coupling member coupled between the at least one cam member and the heat transfer device, each of the at least one first coupling member rotates about a pivot point and each of the at least one second coupling member moves in a substantially linear direction in response to rotation of the at least one cam member; and a plurality of bell cranks, each bell crank rotatably coupled to the housing and to the heat transfer device, the at least one cam member being coupled to the bell cranks via the at least one first coupling member and the at least one second coupling member such that rotation of the at least one cam member causes the bell cranks to rotate and the heat transfer device to rotate between the first and second positions, wherein each at least one first coupling member is coupled to at least one of the bell cranks and to the at least one cam member such that rotation of the at least one cam member causes the at least one first coupling member to move which causes the at least one bell crank to move the heat transfer device between the first and second positions, wherein the at least one first coupling member comprises a plurality of first coupling members, and the positioning mechanism further comprises a first shaft coupled between the first coupling members so that the plurality of first coupling members move substantially in unison.

* * * * *